US006966266B1

(12) United States Patent
Schwendt

(10) Patent No.: US 6,966,266 B1
(45) Date of Patent: Nov. 22, 2005

(54) DEVICE FOR THE RADIAL CONTROL OF A RAIL VEHICLE

(75) Inventor: Lutz Schwendt, Vellmar (DE)

(73) Assignee: Bombardier Transporation GmbH

( * ) Notice: Subject to any disclaimer, the term of this patent is extended or adjusted under 35 U.S.C. 154(b) by 0 days.

(21) Appl. No.: 10/130,974

(22) PCT Filed: Nov. 22, 2000

(86) PCT No.: PCT/EP00/11614

§ 371 (c)(1),
(2), (4) Date: Oct. 1, 2002

(87) PCT Pub. No.: WO01/38155

PCT Pub. Date: May 31, 2001

(30) Foreign Application Priority Data

Nov. 25, 1999 (DE) ..... 199 56 655

(51) Int. Cl.[7] ..... B61D 1/00

(52) U.S. Cl. ..... 105/167; 105/168; 105/182.1; 105/165

(58) Field of Search ..... 105/182.1, 174, 105/175.1, 196, 165, 167, 218.2, 168, 164, 105/169, 187, 194

(56) References Cited

U.S. PATENT DOCUMENTS 2,812,725 A * 11/1957 Candlin, Jr. et al. ..... 105/4.3
4,235,451 A 11/1980 Leriverend
5,007,496 A * 4/1991 Whitten et al. ..... 180/401
5,263,420 A * 11/1993 Schwendt et al. ..... 105/166
5,277,127 A 1/1994 Euwijk et al.

FOREIGN PATENT DOCUMENTS

| | | | | |
|---|---|---|---|---|
| DE | 44 19 878 C1 | | 7/1995 | |
| DE | 4419878 C1 | * | 7/1995 | ..... B61F 00/00 |
| DE | 44 15 293 A1 | | 11/1995 | |
| DE | 4415293 A1 | * | 11/1995 | ..... B61F 3/02 |
| DE | 19712752 A1 | * | 10/1998 | ..... B61D 3/10 |
| EP | 0 134 202 A2 | | 3/1985 | |
| EP | 0 329 440 A2 | | 8/1989 | |
| EP | 329440 A2 | * | 8/1989 | ..... B61F 5/44 |
| FR | 2 515 595 A1 | | 5/1983 | |
| WO | WO 95/16597 A1 | | 6/1995 | |

* cited by examiner

*Primary Examiner*—Frantz F. Jules
(74) *Attorney, Agent, or Firm*—Jacobus C. Rasser; David P. Owen; Howrey LLP

(57) ABSTRACT

The invention relates to a device for the radial control of a rail vehicle. According to the invention, at least one wheel set (1) is mounted in a bogie or chassis and the ends of said wheel set(s) can be adjusted in the longitudinal direction of the vehicle, using actuating devices (12, 19, 21, 26). The ends of the wheel set are adjusted in a longitudinal direction by a foldable wheel-set driving rod (8/9, 15/16), the actuating device engaging with the joint (11, 18) of said foldable wheel-set driving rod.

21 Claims, 5 Drawing Sheets

DEVICE FOR THE RADIAL CONTROL OF A RAIL VEHICLE

BACKGROUND OF THE INVENTION

1. Field of the Invention

The invention relates to a device for radially controlling a rail vehicle and a method for achieving the same.

2. Description of the Related Art

In bogies with radial control, the ends of the wheel set or wheel set bearings of a wheel set which are mounted in the bogie frame or vehicle body must be adjusted in the longitudinal direction. This adjustment can take place passively by means of longitudinal forces occurring in bends or actively by means of actuation elements using external energy or by means of mechanical transmission of geometric movements in the vehicle occurring in bends.

In systems with active control, actuation elements with hydraulic, pneumatic or electrical actuation energy, which are installed instead of the wheel set driving rods, are used to adjust the wheel set bearings. This has the disadvantage that the entire tensile force and braking force is directed via these actuation elements, for which reason they have to be made correspondingly strong, which is costly. In addition, it is absolutely necessary for safety reasons that when there is a failure of the actuation elements, of the actuation element control or of the power supply to the actuation elements a defined position is reliably assumed automatically. When there is mechanical active or passive actuation via linkages, the full tensile forces and braking forces must also be directed via the linkage, which requires a correspondingly strong configuration and is also costly.

The invention is based on the object of specifying a cost-effective device for radially controlling a rail vehicle.

BRIEF SUMMARY OF THE INVENTION

This may be achieved according to the invention by means of an arrangement for radially controlling a rail vehicle comprising at least one wheel set mounted to a bogie or to the vehicle body. The wheel set ends are adjustable in the longitudinal direction of the vehicle by means of actuating devices, the longitudinal adjustment of the ends of the wheel set being carried out by means of foldable wheel set driving rods. The actuating devices are actuatable to cause folding of the foldable wheel set driving rods.

The invention further contemplates a rail vehicle having a wheel set having a first end and a second end, the wheel set ends being arranged for movement in the longitudinal direction with respect to the vehicle and a pair of foldable wheel set driving rods, a first end of each driving rod being attached to a fixed point located on the rail vehicle body or bogie, a second end of each driving rod being mounted to a respective wheel set end. A pair of actuating devices, are mounted for engagement with respective foldable wheel set driving rods wherein actuation of one of the actuating devices causes folding of the respective foldable wheel set driving rod and movement of the respective wheel set end in the longitudinal direction with respect to the respective fixed point.

The invention also contemplates a method of radially controlling a rail vehicle comprising a wheel set, mounted to a bogie or to the vehicle body, and having a first end and a second end. The wheel set ends are arranged for movement in the longitudinal direction with respect to the vehicle by means of a pair of foldable wheel set driving rods, a first end of each driving rod being attached to the vehicle body or bogie, a second end of each driving rod being mounted to a respective wheel set end. The method comprises exerting a lateral force on one of the foldable wheel set driving rods to cause folding of the rod and longitudinal movement of the respective wheel set end with respect to the vehicle body or bogie.

The wheel set driving rod present in customary bogies without radial control is accordingly embodied according to the invention in such a way that it can be folded by means of a joint located approximately in the center. This folding enables the effective length of the wheel set driving rod to be changed (shortened) by the necessary amount so that the position of the wheel set bearing is changed as desired and the wheel set assumes the necessary radial position. The folding can be initiated by means of electrical, pneumatic, hydraulic or mechanical activation and the resetting into the extended normal position takes place reliably by means of spring force in the case of electrical, pneumatic or hydraulic activation, and optionally by means of restricted guidance by the linkage in the case of mechanical activation.

The advantages which can be achieved with the invention are in particular the fact that the adjustment forces which are necessary for radial control, and the application of the tensile force and braking force is significantly less than in the case of direct guidance as only the transverse forces acting in the folded driving rod by means of the generally known toggle lever effect are effective for the adjustment mechanism. In the case of resetting by means of spring force, the original position (extended normal position) is assumed in a stable fashion as the transverse forces which then act in the wheel set driving rod are very low or zero.

Advantageous refinements of the invention are characterized in the subclaims.

Further advantages of the proposed device emerge from the description below.

BRIEF DESCRIPTION OF THE DRAWINGS

The invention will be explained in more detail below with reference to the exemplary embodiments illustrated in the drawing, in which.

DESCRIPTION OF ILLUSTRATIVE EMBODIMENTS

Figure 1:
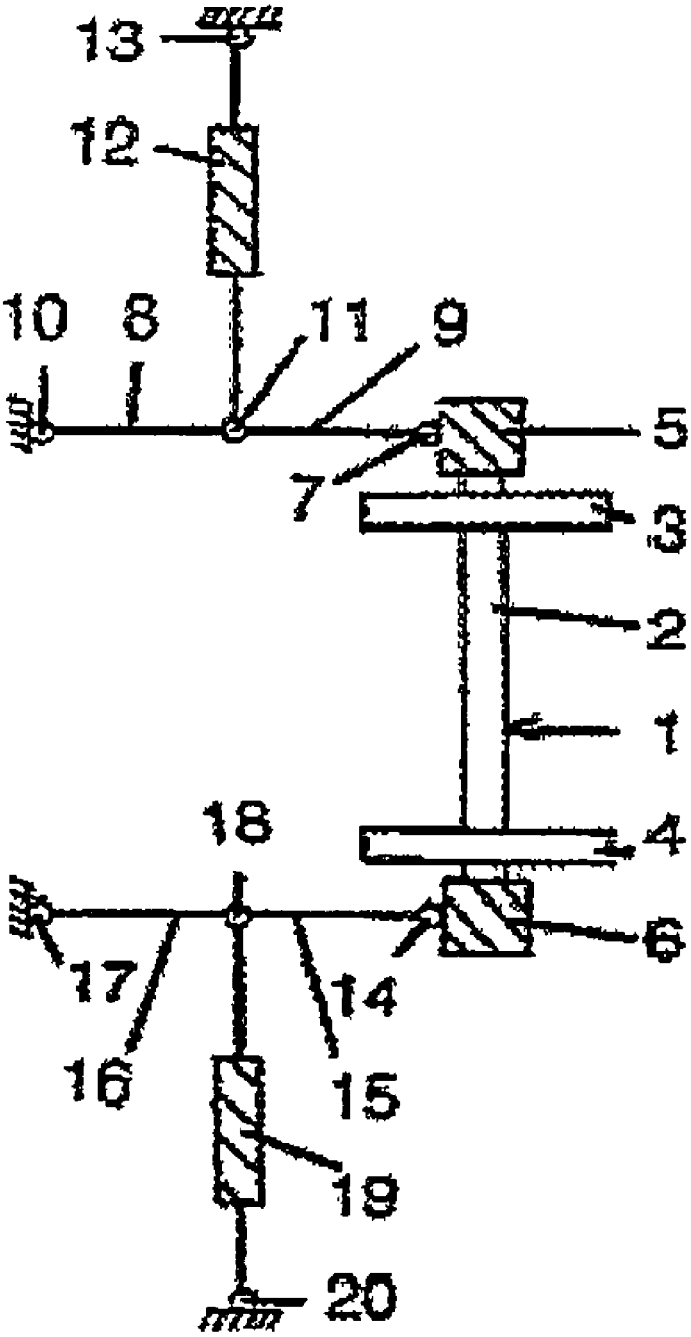
FIG. 1 shows a view of the device according to the invention according to a first variant.

FIG. 1 is a view of the device according to the invention according to a first variant. A wheel set 1 of a bogie with axle 2 and wheels 3, 4 is shown. The wheel set 1 is mounted and guided in wheel set bearing housings 5, 6. Wheel set driving rods guide the wheel set bearing housings and thus the wheel set in the longitudinal direction of the vehicle. The wheel set driving rods are each divided into two driving rod sections 8, 9 and 15, 16, respectively, the wheel set driving rods 8/9 and 15/16 each being connected to one another in a foldable fashion by means of a joint 11 and 18, respectively. The respective first driving rod sections 8 and 16 are attached to the bogie frame or vehicle body by means of connecting points 10 and 17, respectively. The respective second driving rod sections 9 and 15 are attached to the wheel set bearing housing 5 and 6, respectively, via connecting points 7 and 14, respectively.

In each case an actuator element (activation device) 12 or 19, which is attached at the other end to the bogie frame or vehicle body via a connecting point 13 or 20, engages on the joints 11 and 18. When the actuator element 12 is activated, the wheel set driving rod 8/9 is folded out, as a result of which the distance between the connecting points 7 and 10 is shortened and the relative position of the wheel set bearing 5 with respect to the bogie frame or with respect to the vehicle body is changed. When the actuator element 19 is activated, the further wheel set driving rod 15/16 is folded out, as a result of which the distance between the connecting points 14 and 17 is shortened and the relative position of the wheel set bearing 6 with respect to the bogie frame or with respect to the vehicle body is changed.

According to the invention, depending on whether a left-hand or right-hand bend is being traveled into, only one of the wheel set driving rods 8/9 or 15/16 is shortened so that the wheel set 1 is placed in the desired oblique position in the desired direction for traveling around a bend.

The actuator elements 12, 19 can be embodied as electrically, hydraulically or pneumatically activated components. The control pulse for activating an actuator element 12, 19 is generated by the vehicle controller if, for example, it is detected that the vehicle is traveling round a bend, by means of centrifugal force or by means of an external control device. Here, a correspondingly controlled and supervised actuator 12, 19 can precisely bring about a radial setting which is adapted to the radius of the bend.

In order to simplify the control of the actuator elements 12, 19 and to avoid control errors, the adjustability of the actuator elements 12, 19 can be reduced to merely two settings, specifically to the basic setting (wheel set driving rod straight ahead) and to a folded position (for traveling round a right-hand or left-hand bend). In this way, although the optimum radial setting is not achieved in all cases or not achieved for all bend radii, this does not lead to appreciable disadvantages in terms of the driving behavior of the vehicle.

Figure 2:
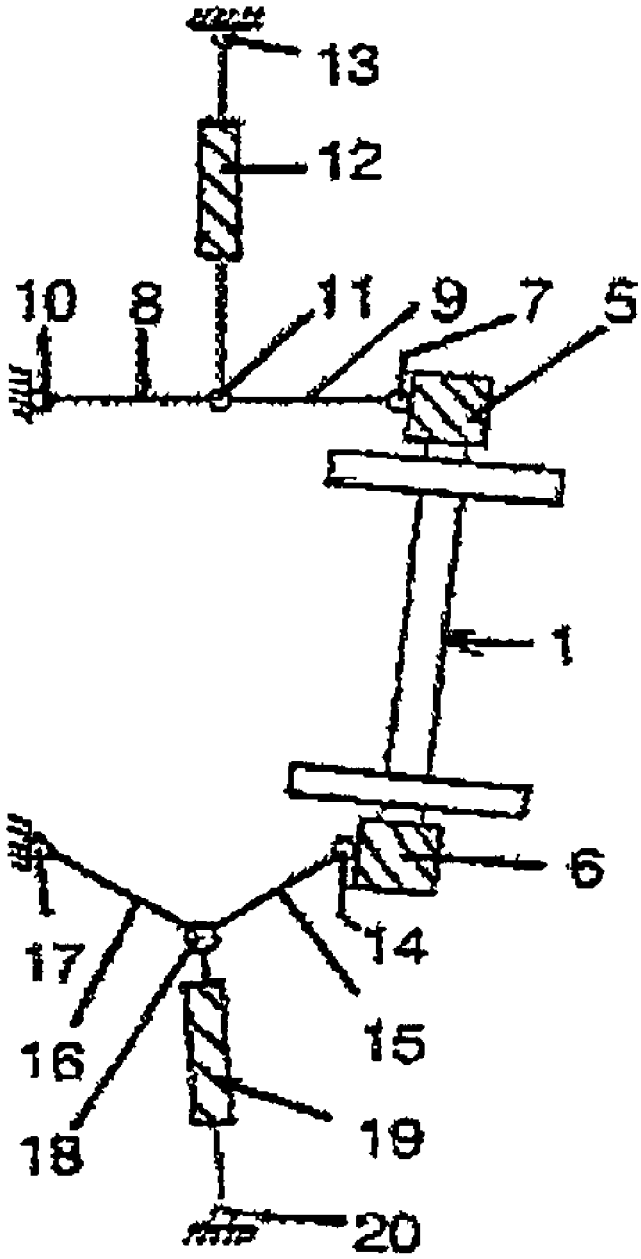
FIG. 2 shows the device according to a first variant when traveling around a bend.

FIG. 2 illustrates a first variant of the device when traveling round a bend. Actuator element 12 is not activated, i.e. the wheel set driving rod 8/9 is in the extended normal position. The wheel set driving rod 15/16 is folded in by activating the actuator element 19, as a result of which the desired oblique position of the wheel set 1 for traveling round a bend is set.

Figure 3:
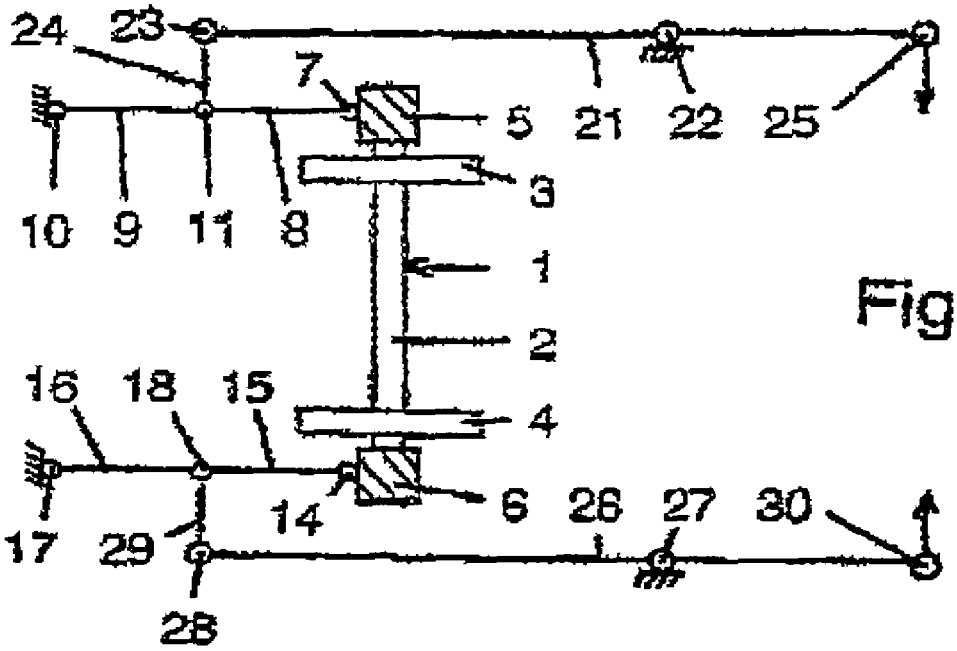
FIG. 3 shows a view of the device according to the invention according to a second variant.

FIG. 3 illustrates a view of a second variant of the device according to the invention. The arrangement with wheel set 1, wheel set bearing housings 5, 6, wheel set driving rods 8/9 and 15/16 with joints 11 and 18 and coupling points 7, 10, 14, 17 is as described with respect to FIG. 1. The folding-out of the wheel set driving rods 8/9 and 15/16 is not, however, carried out by means of actuator elements 12 and 19 but rather by means of a mechanical linkage. Here, a lever 21 which is attached to a pivot 22 engages on the joint 11 by means of a joint 23 and a rod 24. At the further end of the lever 21 there is a joint 25 which is activated by means of a rod (not illustrated), for example by means of transverse displacement of a center wheel set of triple-axle bogies (or generally a triple-axle configuration) or by means of the rotation angle of the bogie with respect to the vehicle body. In the same way, a lever 26 which is attached to a pivot 26 engages on the joint 18 via a joint 28 and a rod 29. At the further end of the lever 26 there is a joint 30 which is activated via a rod (not illustrated), for example by means of transverse displacement of a center wheel set of triple-axle bogies or by means of the rotation angle of the bogie with respect to the vehicle body.

Figure 4:
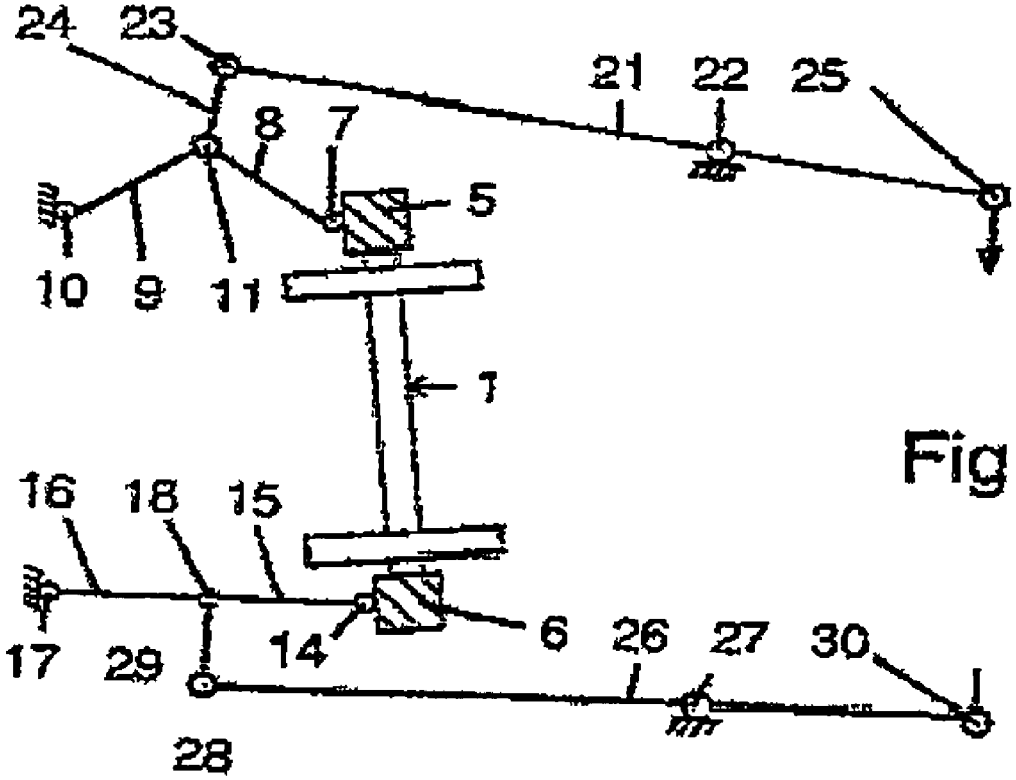
FIG. 4 shows the device according to the second variant when traveling around a bend.

In FIG. 4, the device is illustrated in accordance with a second variant when traveling around a bend. The lever 26 is not activated, i.e. the wheel set driving rod 15/ is located in the extended normal position. When the lever 21 is activated, the wheel set driving rod 8/9 is folded in, as a result of which the desired oblique position of the wheel set 1 for traveling around a bend is set.

Figure 5:
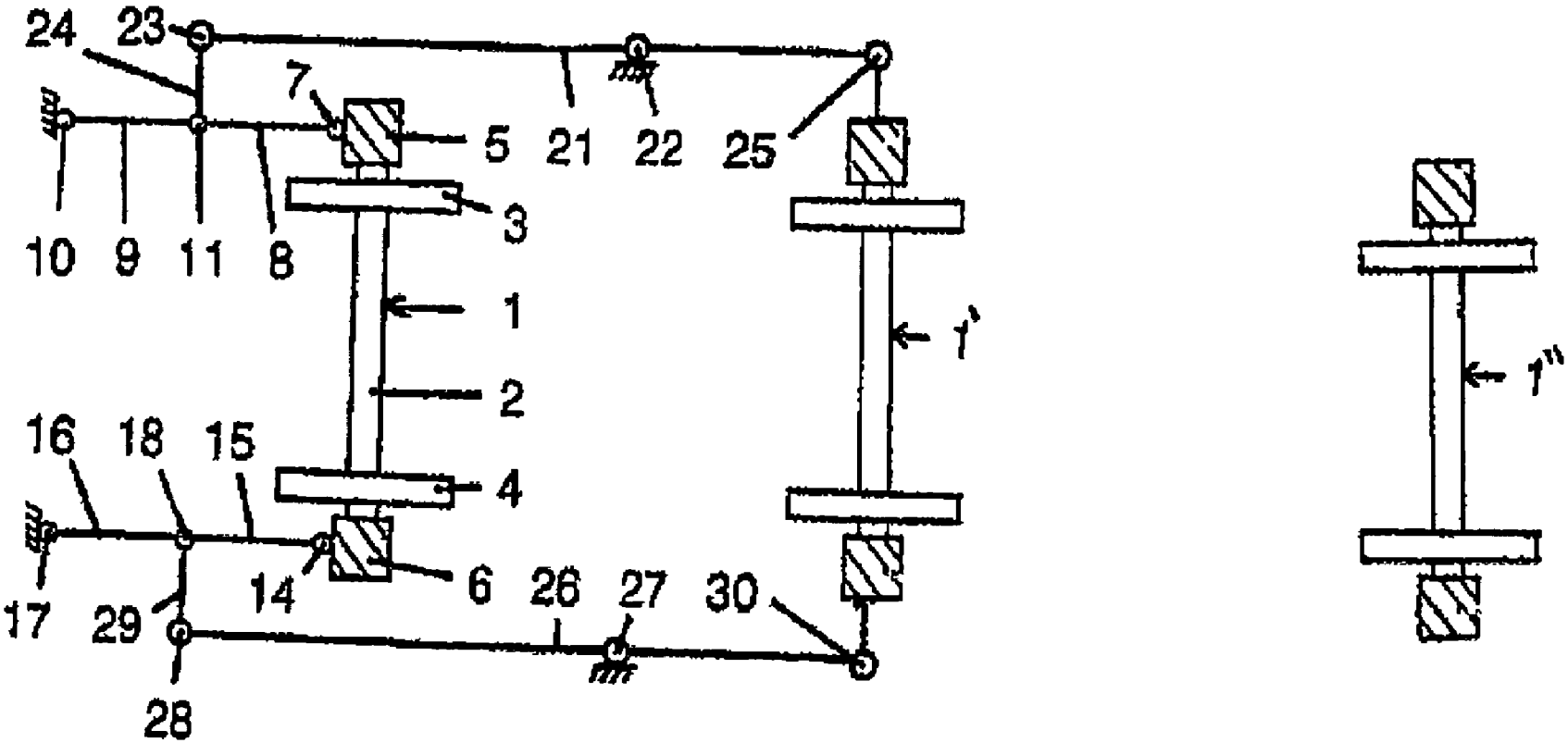
FIG. 5 shows the device according to the second variant with actuation by the center wheel set of a triple-axle bogie.

FIG. 5 is a view of the device corresponding to FIG. 3 showing the three wheel sets 1, 1', 1" of a triple-wheel set bogie. The connection of the center wheel set 1' to the joint 25 and the joint 30 is schematically shown.

What is claimed is:

1. An arrangement for radially controlling a rail vehicle, the arrangement comprising at least one wheel set mounted to a bogie or to the vehicle body, the wheel set ends being adjustable in the longitudinal direction of the vehicle by means of actuating devices, the longitudinal adjustment of the ends of the wheel set being carried out by means of foldable wheel set driving rods, the actuating devices acting on the foldable wheel set driving rods to cause folding thereof from a generally straight normal position to a folded position.

2. The arrangement as claimed in claim 1, wherein the foldable wheel set driving rods are foldable at a hinge point and each actuating device acts at the hinge point of the corresponding foldable wheel set driving rod.

3. The arrangement as claimed in claim 1, wherein the actuating devices are electrical or pneumatic or hydraulic actuator elements.

4. The arrangement as claimed in claim 3, wherein the actuator elements are actuatable between two positions corresponding to straight and folded wheel set driving rod positions.

5. The arrangement as claimed in claim 1, wherein the folding of the wheel set driving rods is carried out by means of a mechanical linkage with a lever attached to a pivot.

6. The arrangement as claimed in claim 5, wherein the arrangement comprises three wheel sets in a three-axle configuration and the mechanical linkage can be actuated by displacing of the centre wheel set.

7. The arrangement as claimed in claim 5, wherein the mechanical linkage can be actuated by the rotational movement of the bogie with respect to the vehicle body.

8. A rail vehicle having:

a wheel set having a first end and a second end, the wheel set ends being arranged for movement in the longitudinal direction with respect to the vehicle;

a pair of foldable wheel set driving rods, a first end of each driving rod being attached to a fixed point located on the rail vehicle body or bogie, a second end of each driving rod being mounted to a respective wheel set end; and a pair of actuating devices, each actuating device being mounted for engagement with a respective foldable wheel set driving rod wherein actuation of one of the actuating devices causes folding of the respective foldable wheel set driving rod and movement of the respective wheel set end in the longitudinal direction with respect to the respective fixed point.

9. The rail vehicle according to claim 8, wherein the foldable wheel set driving rods comprise hinge points and the actuating devices act at the hinge points of the foldable wheel set driving rods.

10. The rail vehicle according to claim 8, wherein the actuating devices are electrical, pneumatic or hydraulic actuator elements.

11. The rail vehicle according to claim 10, wherein the actuating devices are actuatable between two positions corresponding to straight and folded wheel set driving rod positions.

12. The rail vehicle according to claim 8, wherein the actuating devices comprise mechanical linkages with a lever attached to a pivot.

13. The rail vehicle according to claim 12, wherein the rail vehicle has three wheel sets in a three-axle configuration and the mechanical linkage can be actuated by displacing of the centre wheel set.

14. The rail vehicle according to claim 12, wherein the mechanical linkage can be actuated by the rotational movement of the bogie with respect to the vehicle body.

15. A method of radially controlling a rail vehicle comprising a wheel set, the wheel set being mounted to a bogie or to the vehicle body and having a first end and a second end, the wheel set ends being arranged for movement in the longitudinal direction with respect to the vehicle by means of a pair of foldable wheel set driving rods, a first end of each driving rod being attached to the vehicle body or bogie, a second end of each driving rod being mounted to a respective wheel set end; the method comprising exerting a lateral force on one of the foldable wheel set driving rods to cause folding of the rod and longitudinal movement of the respective wheel set end with respect to the vehicle body or bogie.

16. The method according to claim 15 wherein the force is exerted by an actuating device.

17. The method according to claim 16 wherein the actuating device is an electrical, pneumatic or hydraulic actuator element.

18. The method according to claim 17 wherein the actuating devices are actuated between two positions corresponding to straight and folded wheel set driving rod positions.

19. The method according to claim 16 wherein the actuating device comprises a mechanical linkage with a lever attached to a pivot.

20. The method according to claim 19 wherein the vehicle comprises three wheel sets in a three-axle configuration and the mechanical linkage is actuated by displacing of the centre wheel set.

21. The method according to claim 16 wherein the mechanical linkage can be actuated by the rotational movement of the bogie with respect to the vehicle body.

* * * * *